US006076022A

United States Patent [19]

Hagart-Alexander et al.

[11] Patent Number: 6,076,022

[45] Date of Patent: Jun. 13, 2000

[54] PAPER STOCK SHEAR AND FORMATION CONTROL

[75] Inventors: Claud Hagart-Alexander, Vancouver, Canada; Hung-Tzaw Hu, Saratoga, Calif.; David Watson, Etobicoke, Canada

[73] Assignee: Honeywell-Measurex Corporation, Cupertino, Calif.

[21] Appl. No.: 09/013,802

[22] Filed: Jan. 26, 1998

[51] Int. Cl.[7] ..... G06F 19/00; G06G 7/66

[52] U.S. Cl. ..... 700/127; 700/122; 700/128; 700/142

[58] Field of Search ..... 700/142, 128, 700/122, 118, 179, 186, 173, 1; 162/259; 235/151.1

[56] References Cited

U.S. PATENT DOCUMENTS

| | | | |
|---|---|---|---|
| 3,206,642 | 9/1965 | Canter et al. | 361/7 |
| 3,593,128 | 7/1971 | Perry | 324/606 |
| 3,595,487 | 7/1971 | Bidwell | 241/21 |
| 3,630,836 | 12/1971 | Bietry et al. | 162/198 |
| 3,636,327 | 1/1972 | Troutman | 702/175 |
| 3,646,434 | 2/1972 | Norwich | 324/669 |
| 3,654,075 | 4/1972 | Keyes et al. | 162/254 |
| 3,666,621 | 5/1972 | Adams | 162/198 |
| 3,711,687 | 1/1973 | Stout et al. | 700/128 |
| 3,713,966 | 1/1973 | Lippke | 162/263 |
| 3,723,712 | 3/1973 | Komline, Sr. et al. | 137/93 |
| 3,723,865 | 3/1973 | Batey et al. | 324/665 |
| 3,795,984 | 3/1974 | Meyer | 34/535 |
| 3,811,087 | 5/1974 | Schmelzer | 324/668 |
| 3,864,626 | 2/1975 | MacLean et al. | 324/663 |
| 3,909,380 | 9/1975 | Day et al. | 204/645 |
| 3,986,110 | 10/1976 | Overall et al. | 73/304 |
| 4,135,151 | 1/1979 | Rogers et al. | 324/664 |
| 4,259,632 | 3/1981 | Ahtiainen | 324/664 |
| 4,314,878 | 2/1982 | Lee | 162/198 |
| 4,329,201 | 5/1982 | Bolton | 162/198 |
| 4,369,080 | 1/1983 | Johnson | 156/64 |
| 4,398,996 | 8/1983 | Bolton et al. | 162/198 |
| 4,468,611 | 8/1984 | Tward | 324/673 |
| 4,474,643 | 10/1984 | Lindblad | 162/198 |
| 4,500,968 | 2/1985 | Bialkowski | 700/128 |
| 4,514,812 | 4/1985 | Miller et al. | 700/196 |
| 4,535,285 | 8/1985 | Evans et al. | 162/263 |
| 4,580,233 | 4/1986 | Parker et al. | 73/73 |
| 4,588,943 | 5/1986 | Hirth | 324/664 |
| 4,613,406 | 9/1986 | Gess | 162/49 |
| 4,648,715 | 3/1987 | Ford, Jr. et al. | 204/452 |
| 4,680,089 | 7/1987 | Aral et al. | 162/198 |
| 4,692,616 | 9/1987 | Hegland et al. | 250/252.1 |
| 4,707,779 | 11/1987 | Hu | 700/55 |
| 4,748,400 | 5/1988 | Typpo | 324/670 |
| 4,786,529 | 11/1988 | Boissevain | 427/296 |
| 4,791,353 | 12/1988 | Typpo | 324/667 |
| 4,817,021 | 3/1989 | Sowerby et al. | 702/137 |

(List continued on next page.)

OTHER PUBLICATIONS

Smook, G.A., Handbook for Pulp & Paper Technologist, 2d. ed., (Angus Wilde Publications), 1992, pp. 228–9.

*Primary Examiner*—William Grant
*Assistant Examiner*—Iván Calcano
*Attorney, Agent, or Firm*—Burns, Doane, Swecker & Mathis, L.L.P.

[57] ABSTRACT

System and method for producing paper are provided. The system controls formation of wet stock comprising fibers on a moving water permeable wire of a de-watering machine that has a refiner that is subject to a variable load and a headbox having at least one slice, wherein each slice has an aperture through which wet stock is discharged at a certain stock jet speed onto the wire that is moving at a certain wire speed. The system includes: a) at least two water weight sensors that are positioned adjacent to the wire wherein the at least two sensors are positioned at different locations in the direction of movement of the wire and upstream from a dry line which develops during operation of the machine and the sensors generate signals indicative of a water weight profile made up of a multiplicity of water weight measurements; and b) means for adjusting at least one of the stock jet speed, wire speed, or to cause the water weight profile to match a preselected or optimal water weight profile.

35 Claims, 7 Drawing Sheets

U.S. PATENT DOCUMENTS

| | | | |
|---|---|---|---|
| 4,827,121 | 5/1989 | Vidrine, Jr. et al. | 356/346 |
| 4,840,706 | 6/1989 | Campbell | 162/198 |
| 4,845,421 | 7/1989 | Howarth et al. | 324/668 |
| 4,903,528 | 2/1990 | Balakrishnan et al. | 73/159 |
| 4,909,070 | 3/1990 | Smith | 73/73 |
| 4,921,574 | 5/1990 | Hu | 162/198 |
| 4,924,172 | 5/1990 | Holmgren | 324/664 |
| 4,947,684 | 8/1990 | Balakrishnan | 73/159 |
| 4,957,770 | 9/1990 | Howarth | 427/9 |
| 4,980,846 | 12/1990 | Chapman | 700/167 |
| 4,986,410 | 1/1991 | Shields | 198/444 |
| 4,990,261 | 2/1991 | Ho | 210/709 |
| 4,994,145 | 2/1991 | Seymour | 162/49 |
| 5,013,403 | 5/1991 | Chase | 162/49 |
| 5,020,469 | 6/1991 | Boissevain et al. | 118/67 |
| 5,021,740 | 6/1991 | Sarr et al. | 324/687 |
| 5,022,966 | 6/1991 | Hu | 162/198 |
| 5,045,798 | 9/1991 | Hendrick | 324/687 |
| 5,052,223 | 10/1991 | Regnault et al. | 73/304 C |
| 5,067,345 | 11/1991 | Mougne | 73/61.44 |
| 5,071,514 | 12/1991 | Francis | 162/259 |
| 5,093,795 | 3/1992 | Lewis | 700/129 |
| 5,122,754 | 6/1992 | Gotaas | 324/676 |
| 5,124,552 | 6/1992 | Anderson | 250/339.04 |
| 5,132,631 | 7/1992 | Klopfenstein et al. | 324/676 |
| 5,134,380 | 7/1992 | Jonas | 324/674 |
| 5,170,128 | 12/1992 | Masurat et al. | 324/664 |
| 5,170,670 | 12/1992 | Fasching et al. | 73/861.08 |
| 5,177,445 | 1/1993 | Cross | 324/637 |
| 5,198,777 | 3/1993 | Masuda et al. | 324/671 |
| 5,206,599 | 4/1993 | Mayer | 324/671 |
| 5,208,544 | 5/1993 | McBrearty et al. | 324/687 |
| 5,225,785 | 7/1993 | Mayer et al. | 324/671 |
| 5,241,280 | 8/1993 | Aidun et al. | 324/671 |
| 5,244,550 | 9/1993 | Inoue | 204/272 |
| 5,247,261 | 9/1993 | Gershenfeld | 324/716 |
| 5,262,955 | 11/1993 | Lewis | 700/129 |
| 5,270,664 | 12/1993 | McMurtry et al. | 324/690 |
| 5,280,250 | 1/1994 | Jayaweera et al. | 324/438 |
| 5,340,442 | 8/1994 | Gess et al. | 162/198 |
| 5,400,247 | 3/1995 | He | 700/53 |
| 5,439,910 | 8/1995 | De Fraine | 514/357 |
| 5,450,015 | 9/1995 | Mastico et al. | 324/665 |
| 5,492,601 | 2/1996 | Ostermayer et al. | 162/198 |
| 5,539,634 | 7/1996 | He | 760/38 |
| 5,561,599 | 10/1996 | Lu | 700/44 |
| 5,563,809 | 10/1996 | Williams et al. | 702/84 |
| 5,636,126 | 6/1997 | Heaven et al. | 700/129 |
| 5,658,432 | 8/1997 | Heaven et al. | 162/253 |
| 5,825,653 | 10/1998 | Huovila et al. | 700/128 |
| 5,853,543 | 12/1998 | Hu et al. | 162/198 |
| 5,928,475 | 7/1999 | Chase et al. | 162/198 |

PAPER STOCK SHEAR AND FORMATION CONTROL

FIELD OF THE INVENTION

The present invention generally relates to controlling continuous sheetmaking and, more specifically, to controlling formation and fiber shear on the fourdriner wire of a papermaking machine.

BACKGROUND OF THE INVENTION

In the art of making paper with modern high-speed machines, sheet properties must be continually monitored and controlled to assure sheet quality and to minimize the amount of finished product that is rejected when there is an upset in the manufacturing process. The sheet variables that are most often measured include basis weight, moisture content, and caliper (i.e., thickness) of the sheets at various stages in the manufacturing process. These process variables are typically controlled by, for example, adjusting the feedstock supply rate at the beginning of the process, regulating the amount of steam applied to the paper near the middle of the process, or varying the nip pressure between calendaring rollers at the end of the process. Papermaking devices well known in the art are described, for example, in "Handbook for Pulp & Paper Technologists" 2nd ed., G. A. Smook, 1992, Angus Wilde Publications, Inc., and "Pulp and Paper Manufacture" Vol III (Papermaking and Paperboard Making), R. MacDonald, ed. 1970, McGraw Hill. Sheetmaking systems are further described, for example, in U.S. Pat. Nos. 5,539,634, 5,022,966 4,982,334, 4,786,817, and 4,767,935.

In the manufacture of paper on continuous papermaking machines, a web of paper is formed from an aqueous suspension of fibers (stock) on a traveling mesh papermaking fabric and water drains by gravity and vacuum suction through the fabric. The web is then transferred to the pressing section where more water is removed by dry felt and pressure. The web next enters the dryer section where steam heated dryers and hot air completes the drying process. The paper machine is essentially a de-watering system. In the sheetmaking art, the term machine direction (MD) refers to the direction that the sheet material travels during the manufacturing process, while the term cross direction (CD) refers to the direction across the width of the sheet which is perpendicular to the machine direction.

In the papermaking process, the major factors at the wire that influence the formation and strength of the paper include: (1) the stock jet speed to wire speed (jet/wire) ratio; (2) the angle that the stock jet lands on the wire; and (3) the rate of water drainage from the web. The speed differential between the stock jet and the wire speed determines the average orientation of the pulp fibers throughout the paper web between the cross, machine, and Z (wet stock height) directions. The average orientation of the fibers within the sheet is critical to both paper formation and sheet strength.

Current machine start-up procedures require optimization of the papermaking machine at different jet/wire ratios and to perform laboratory tests to identify the jet/wire ratio that produces the requisite formation and strength characteristics of the paper. The test results may take several hours and require several trial-and-error changes to the jet/wire ratio before acceptable results are obtained.

SUMMARY OF THE INVENTION

The present invention is based in part on the development of an underwire water weight sensor (referred to herein as the "$UW^3$" sensor) which is sensitive to three properties of materials: the conductivity or resistance, the dielectric constant, and the proximity of the material to the $UW^3$ sensor. Depending on the material, one or more of these properties will dominate. The $UW^3$ sensors are positioned in a papermaking machine in the MD direction, and are used to measure the conductivity of an aqueous mixture (referred to as wet stock) in a papermaking system. In this case, the conductivity of the wet stock is high and dominates the measurement of the $UW^3$ sensor. The proximity is held constant by contacting the support web in the papermaking system under the wet stock. The conductivity of the wet stock is directly proportional to the total water weight within the wet stock; consequently, the sensors provide information which can be used to monitor and control the quality of the paper sheet produced by the papermaking system. With the present invention, an array of $UW^3$ sensors is employed to measure the water weight in the MD on the web of a fourdriner paper machine and generate water weight or drainage profiles. These sensors have a very fast response time (1 msec) and are capable of providing an accurate value of the water weight, which relates to the basis weight of the paper. Indeed, the water weight measurements can be computed from the under the wire weight sensor 600 times a second. By monitoring the MD trend of each of the MD sensors in the array, it is possible to correlate the variation of the water weight down the table between each of these sensors. The offset, in terms of time, that is required to overlay these trends to provide the desired correlation is the time that it takes for the unsupported stock slurry to travel from one sensor to the next. From this time, the control system can calculate the speed of the stock down the wire with relation to the wire speed. Since this unsupported stock slurry speed relates to the original stock jet speed, the control system can then monitor and control the jet-to-wire speed ratio and optimize this ratio to give the optimal sheet formation and strength.

The method for tuning the operation of a fourdriner machine to produce a specific paper grade comprises a three-step procedure. The first step comprises tuning process parameters of the fourdriner machine to obtain an optimized configuration which produces acceptable quality paper as determined by direct measurement. The drainage profile corresponding to this optimized configuration is then measured with water weight sensors distributed along the machine direction, and recorded.

This optimal drainage profile may then be fitted to various parameterized functions (such as an exponential) using standard curve fitting techniques. This curve fitting procedure has the effect of smoothing out the effects of noise on the profile, and interpolating between measured points.

During subsequent production runs of the fourdriner machine, the objective is to reproduce the previously determined optimal drainage profile. If the measured moisture content at a given position is either above or below the optimal value for that position, the machine parameters, such as the stock jet speed to wire speed ratio, are adjusted as necessary to bring that measurement closer toward the optimal value.

In one aspect, the invention is directed to a system of controlling that formation of wet stock which comprises fibers on a moving water permeable wire of a de-watering machine that comprises a refiner that subjects the fibers to mechanical action, said refiner having a motor load controller, and a headbox having at least one slice, wherein each slice has an aperture through which wet stock is discharged at a certain stock jet speed onto the wire that is moving at a certain wire speed, which system includes:

a) at least two water weight sensors that are positioned adjacent to the wire wherein the at least two sensors are positioned at different locations in the direction of movement of the wire and upstream from a dry line which develops during operation of the machine and the sensors generate signals indicative of a water weight profile made up of a multiplicity of water weight measurements; and b) means for adjusting at least one of the stock jet speed, wire speed, or motor load controller to cause the water weight profile to match a preselected water weight profile.

The invention will, among other things, increase productivity as the papermaker can now quickly determine the proper jet-to-wire ratio for a particular grade of paper. The paper produced will have optimum fiber orientation that is reflected in the sheet formation and strength.

DETAILED DESCRIPTION OF PREFERRED EMBODIMENTS

The present invention employs a system that includes a plurality of sensors that measure water weight in the MD along the web or wire at the wet end of a papermaking machine, e.g., fourdrinier. These $UW^3$ sensors have a very fast response time (1 msec) so that an essentially instantaneous MD profile of water weight can be obtained. Although the invention will be described as part of a fourdrinier papermaking machine, it is understood that the invention is applicable to other papermaking machines including, for example, twin wire and multiple headbox machines and to paper board formers such as cylinder machines or Kobayshi Formers. Some conventional elements of a papermaking machine are omitted in the following disclosure in order not to obscure the description of the elements of the present invention.

Figure 1A:
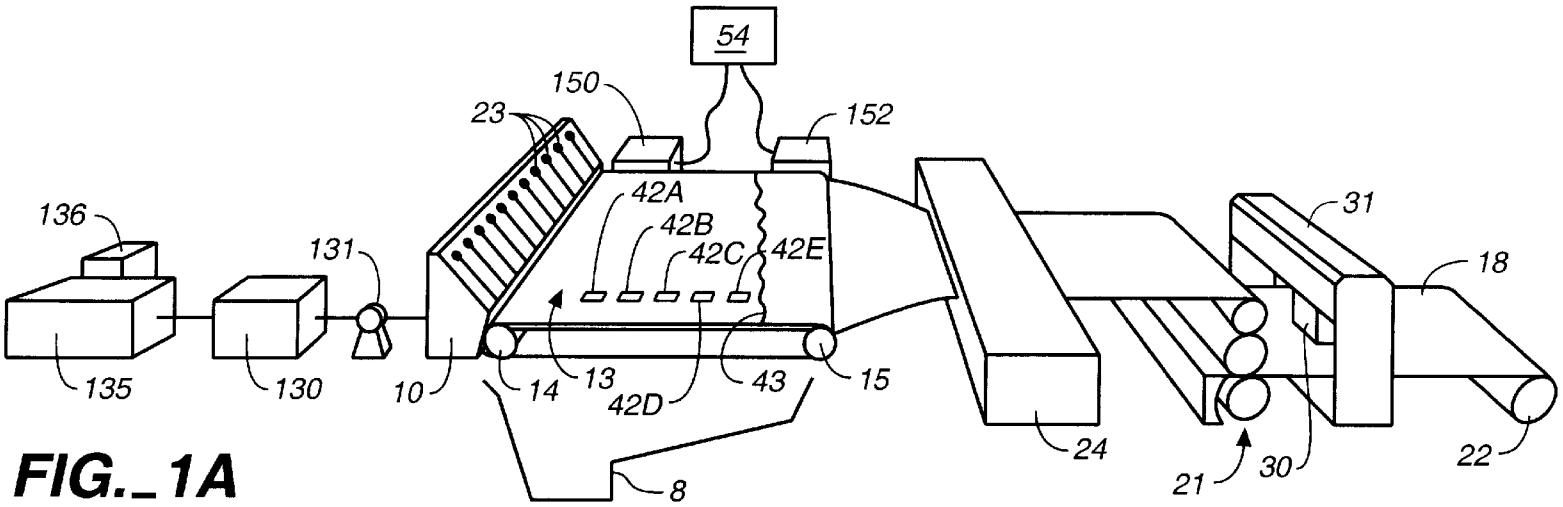
FIG. 1A shows a sheetmaking system implementing the technique of the present invention.

FIG. 1A shows a system for producing continuous sheet material that comprises headbox 10, a calendaring stack 21, and reel 22. Actuators 23 in headbox 10 discharge raw material through a plurality of slices onto supporting web or wire 13 which rotates between rollers 14 and 15 which are driven by motors 150 and 152, respectively. Controller 54 regulates the speed of the motors. Foils and vacuum boxes (not shown) remove water, commonly known as "white water", from the wet stock on the wire into the wire pit 8 for recycle. Sheet material exiting the wire passes through a dryer 24. A scanning sensor 30, which is supported on supporting frame 31, continuously traverses the sheet and measures properties of the finished sheet in the cross-direction. Multiple stationary sensors could also be used. Scanning sensors are known in the art and are described, for example, in U.S. Pat. Nos. 5,094,535, 4,879,471, 5,315,124, and 5,432,353, which are incorporated herein. The finished sheet product 18 is then collected on reel 22. As used herein, the "wet end" portion of the system depicted in FIG. 1A includes the headbox, the web, and those sections just before the dryer, and the "dry end" comprises the sections that are downstream from the dryer.

An array of five $UW^3$ sensors 42A–42E is positioned underneath web 13. By this meant that each sensor is positioned below a portion of the web which supports the wet stock. As further described herein, each sensor is configured to measure the water weight of the sheet material as it passes over the sensor. The sensor provides continuous measurement of the sheet material along the MD direction at the points where it passes each sensor. The sensors are positioned upstream from the dry line 43. A water weight profile made up of a multiplicity of water weight measurements at different locations in the MD is developed. An MD array with a minimum of two sensors is required, preferably 4 to 6 sensors are employed and preferably the sensors are positioned in tandem in the MD about 1 meter from the edge of the wire. Preferably, the sensors are about 30 to 60 cm apart.

In another embodiment, each sensor in the MD array can be replaced with a CD array of the $UW^3$ sensors, that is, each of the five sensors 42A–42E comprises a CD array. Each CD array provides a continuous measurement of the entire sheet material along the CD direction at the point where it passes the array. A profile made up of a multiplicity of water weight measurements at different locations in the CD is developed. An average of these multiple measurements is obtained for each of the five CD arrays can be obtained and an MD profile based on the five average values generated.

The term "water weight" refers to the mass or weight of water per unit area of the wet paper stock which is on the web. Typically, the water weight sensors are calibrated to provide engineering units of grams per square meter (gsm). As an approximation, a reading of 10,000 gsm corresponds to paper stock having a thickness of 1 cm on the fabric. The term "basis weight" refers to the total weight of the material per unit area. The term "dry weight" or "dry stock weight" refers to the weight of a material (excluding any weight due to water) per unit area.

It has been demonstrated that fast variations of water weight on the wire correlate well to fast variations in dry basis weight of the sheet material produced when the water weight is measured upstream from dry line on the wire. The reason is that essentially all of the water on the wire is being held by the paper fibers. Since more fibers hold more water, the measured water weight correlates well to the fiber weight.

The papermaking raw material is metered, diluted, mixed with any necessary additives, and finally screened and cleaned as it is introduced into headbox 10 from source 130 by fan or feeding pump 131. This pump mixes tock with the white water and deliver the blend to the headbox 10.

The process of preparing the wet stock includes the step of subjecting the fibers to mechanical action in refiner 135 which includes a variable motor load controller 136. By regulating the refiner one can, among other things, regulate strength development and stock drainability and sheet formation. Many variables affect the refining process and these generally include, for example, the raw materials (e.g., fiber morphology), equipment characteristics, and process variables (e.g., pH). With respect to fiber morphology, it is known that the source of the wood pulp fibers will influence the properties of the paper. Two important characteristics are fiber length and cell wall thickness. A minimum length is required for interfiber bonding, and length is proportional to tear strength. The ratio of pulp fiber length to cell wall thickness which is as an index of relative fiber flexibility and the fiber coarseness value, which is the weight of fiber wall material in a specified fiber length, are two indications of fiber behavior. Generally, pulp characteristics of softwood species differ from those of hardwood species and the paper stock can comprise different blends of softwood and hardwood. This stock ratio of softwood and hardwood can be regulated to affect changes in, for example, the drainability of the wet stock on the wire.

FIG. 2B illustrates headbox 10 having slices 50 which discharge wet stock 55 onto wire 13. In actual papermaking systems, the number of slices in the headbox will be higher. For a headbox that is 300 inches in length, there can be 100 or more slices. The rate at which wet stock is discharged through the nozzle 52 of the slice can be controlled by corresponding actuator which, for example regulates the diameter of the nozzle. The function of the headbox is to take the stock delivered by the fan pump and transform a pipeline flow into an even, rectangular discharge equal in width to the paper machine and at uniform velocity in the machine direction.

Headboxes are typically categorized, depending on the required speed of stock delivery, as open or pressurized types. Pressurized headboxes can be further divided into air-cushioned and hydraulic designs. In the hydraulic design, the discharge velocity from the slice depends directly on the feeding pump pressure. In the air-cushioned type the discharge energy is also derived from the feeding pump pressure, but a pond level is maintained and the discharge head is attenuated by air pressure in the space above the pond.

The total head (pressure) within the box determines the slice jet speed. According to Bernoulli's equation: $v=(2gh)^{1/2}$ where v=jet velocity or speed (m/s); h=head of liquid (m); and g=acceleration due to gravity (9.81 $m/s^2$). The jet of stock emerging from a typical headbox slice contracts in thickness and deflects downward as a result of slice geometry. The jet thickness, together with the jet velocity, determines the volumetric discharge rate from the headbox. The headbox slice is typically a full-width orifice or nozzle with a completely adjustable opening to give the desired rate of flow. The slice geometry and opening determine the thickness of the slice jet, while the headbox pressure determines the velocity.

The main operating variables for the headbox are typically stock consistency and temperature and jet-to-wire speed ratio. Typically, the consistency is set low enough to achieve good sheet formation, without compromising first-pass retention or exceeding the drainage capability of the forming section. Since higher temperature improves stock drainage, temperature and consistency are interrelated variables. Consistency is varied by raising or lowering the slice opening. Since the stock addition rate is typically controlled only by the basis weight valve (not shown), a change in slice opening will mainly affect the amount of white water circulated from the wire pit under the wire.

The ratio of jet velocity to wire velocity is usually adjusted near unity to achieve best sheet formation. If the jet velocity lags the wire, the sheet is said to be "dragged"; if the jet velocity exceeds the wire speed, the sheet is said to be "rushed". Sometimes, it is necessary to rush or drag the sheet slightly to improve drainage or change fiber orientation. The jet speed is not actually measured, but is inferred from the headbox pressure. Typically, the papermaking machine is operated so that the ratio is not equal to 1, rather the ratio preferably ranges from about 0.95 to 0.99 or 1.01 to 1.05.

Practice of the invention relies in part on the development of one or more water weight profiles created during operation of the papermaking machine. The term "water weight profile" refers to a set of water weight measurements as measured by the MD array of sensors. Alternatively, the water weight profile can comprise a curve that is developed by standard curve fitting techniques from this set of measurements. In operation, water weight profiles are created for different grades of paper that are made under different operating conditions including different ambient conditions (e.g., temperature and humidity). For instance, when the machine of FIG. 1A is operating and making a specific grade of paper that has the desired physically properties as determined by laboratory analysis and/or measurement by the scanning sensor, measurements are taken with the $UW^3$ sensors. The measurements will be employed to create a base or optimal water weight profile for that specific grade of paper and under the specific conditions. A database containing base water weight profiles (or base profiles) for different grades of paper manufactured under various operating conditions can be developed. It should be noted that besides developing and maintaining a database of the base water weight profiles, the stock jet speed to wire speed ratio for each profile will also be recorded. Furthermore, this ratio will be close to but not equal to 1. In this fashion, when the base profile from the database is employed to operate the papermaking machine, initially the machine will begin operation at the recorded jet/wire ratio. Thereafter, the ratio is manipulated in order to reproduce the base profile.

During start-up of the papermaking machine, the operator will select the proper base profile from the database. The array of $UW^3$ continuously develops measured water weight profiles which are compared to the base water weight profile. The stock jet speed to wire speed ratio is adjusted until the measured profile matches the base profile. Continual monitoring of the measured water weight profile allows the operator to adjust the jet speed to wire speed ratio should the measured profile deviated beyond a preset range from base profile. Only the wet end of the machine needs to operate during this initial start-up stage. Materials are recycled during this period.

Because the stock jet velocity is generally easier to controlled than the wire speed, a preferred method of adjusting the jet/wire ratio is to maintain a substantially constant wire speed and adjust the pressure in the headbox to regulate the stock jet velocity. It is understood that the invention is applicable where the ratio is adjusted by controlling of the wire speed while maintaining a constant stock jet velocity or by controlling both the jet velocity and wire speed.

Figure 2:
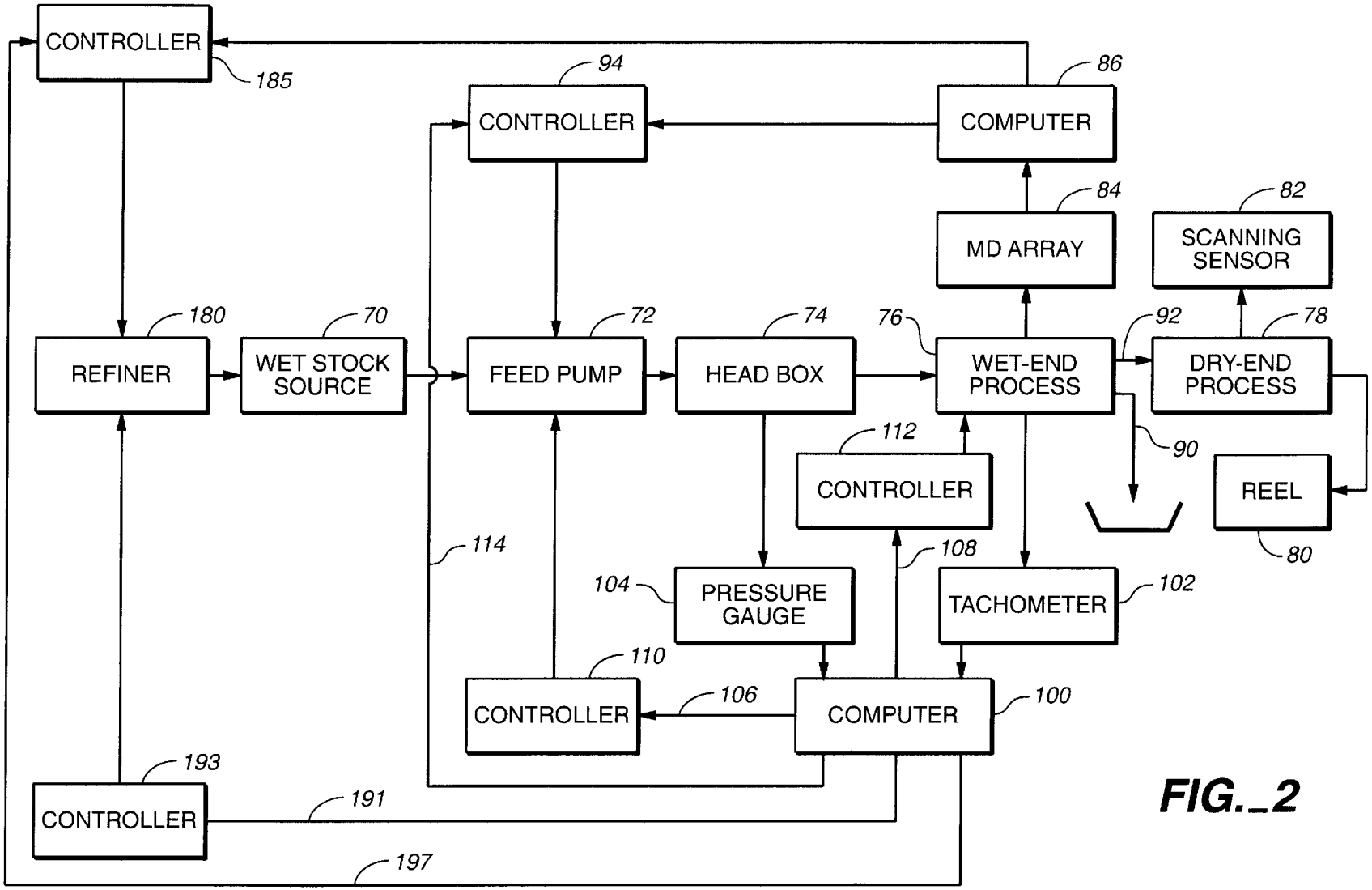
FIG. 2 is a generalized block diagram of the control system.

In operation of the system as illustrated in FIG. 2, wet stock is pumped by feed pump 72 from source 70 to headbox 74. The wet stock is partially dewatered in the wet end process 76 that yields a partially dewatered product. During this initial start-up stage the partially dewatered product 90 can be collected for recycle. After this initial process has been completed, the partially dewatered product 92 will enter the dry end process 78 which yields finished paper that is collected at the reel 80. A scanning sensor 82 measures the dry end basis weight to confirm that the process parameters (e.g., jet/wire ratio) have been correctly selected.

Figure 8:
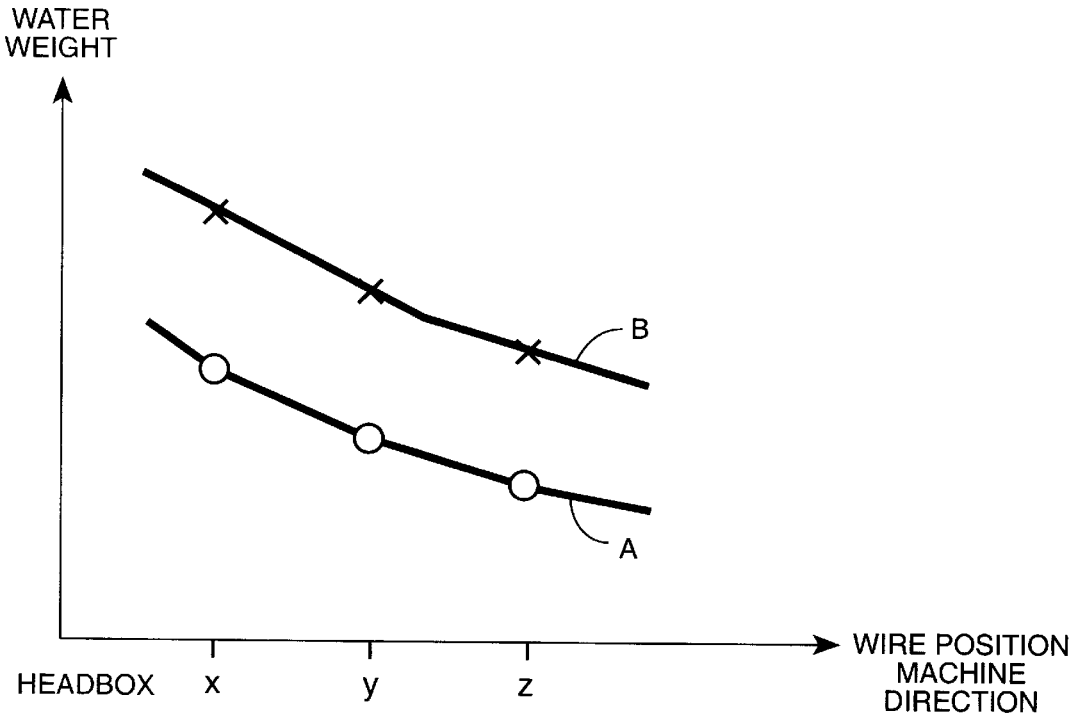
FIG. 8 is a graph of water weight versus wire position on a papermaking machine.

During the initial stage, an MD array of sensors 84 measures the water weight at the wet end and transmit signals to computer 86 which continuously develops water weight profiles of the wet end process. These measured water weight profiles are compared to the base or optimal water weight profile that has been selected for the particular grade of paper being made from a database. FIG. 8 is a graph of water weight versus wire position illustrating implementation of the process. As shown, curve A represents a base or optimal profile that has been preselected from the database for the grade of paper that is being made. During the start-up phase, water weight measurements at the wire are made by the MD array of sensors and from measurements curve B is created using standard curve fitting methods.

As is apparent, in this case the measured water weight values are higher than those of the base profile. As a result, the computer will transmit appropriate signals to controller 94 that will regulate feed pump 72. This curve comparison procedure continues until the measured water weight profile matches the preselected optimized profile. In practice, 100% matching will not be necessary or practical and the level of deviation can be set by the operator. Therefore, it is understood that the term "match" or "matching" implies that the measured water weight profile has the same or approximately the same values as that of the preselected water base weight profile. Referring to FIG. 8, a preferred method of comparing the measured water weight values with those of the base profile entails comparing the three measurements at positions x, y, and z for each profile rather than the two curves. Furthermore, depending on the grade of paper, it may be that measurements closer to the dry line at position z may be more significant that those near the headbox at position x. In this case, the operator may require a higher degree of agreement at position z than at position x. After the proper jet/wire ratio is reached, i.e., when the measured profile matches the base profile, the dry end process goes on line and finished product is made.

As indicated above, the system is preferably operated within certain jet/wire ranges. To assure that the machine is operating within this parameter, the system preferable includes computer 100 which receives signals from wire speed measuring device (e.g., tachometer) 102 and headbox pressure gauge 104. The computer calculates the stock jet speed to wire speed ratio. If the ratio is outside the ratio range (e.g., 1.01 to 1.05) that is set by the operator, the stock jet velocity and/or wire speed can be adjusted accordingly. For example, signal 106 can be transmitted to the controller 110 which increases or decreases the speed of the pump 72. This in turn increases or decreases the stock jet velocity. The computer can also transmit appropriate signals to 108 to controller 112 which regulate the speed of the motors that drive the wire. In addition, the controller can transmit signal 114 to controller 94 which temporarily overrides operation of controller 94 until the jet/wire speed returns to the preset ratio range.

As is apparent, while it is preferred to maintain the jet/wire ratio within a preset range, in the case where either the stock jet velocity or the wire speed is kept constant, it is not necessary to calculate the jet/wire ratio in order to implement the profile matching procedure. The only critical requirement is that the measured water weight profile matches the base profile.

FIG. 2 also illustrates a method of controlling the motor load of refiner 180 in response to wet end process signals. Specifically, when as in the case above, the measured water weight values are higher than those of the base profile, computer 86 will transmit appropriate signals to controller 185 that will regulate the load (e.g, energy to variable motor) of refiner 180. Furthermore, the jet speed to wire speed ratio is outside the ratio range that is set by the operator, signal 191 is transmitted by computer 100 to controller 193 to increase or decrease the motor load. The computer can also transmit appropriate signals 197 to controller 185 temporarily overrides operation of controller 185 until the jet/wire speed returns to the preset ratio range.

Under Wire Water Weight ($UW^3$) Sensor

Figure 3B:
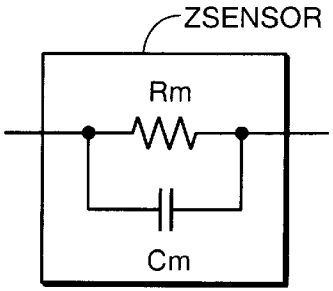
FIG. 3B is an electrical representation of sensor cell impedance.
Figure 3A:
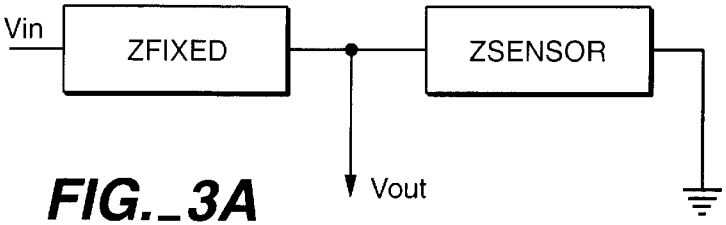
FIG. 3A is a block diagram illustrating impedance in the measurement apparatus.

In its broadest sense, the sensor can be represented as a block diagram as shown in FIG. 3A, which includes a fixed impedance element (Zfixed) coupled in series with a variable impedance block (Zsensor) between an input signal (Vin) and ground. The fixed impedance element may be embodied as a resistor, an inductor, a capacitor, or a combination of these elements. The fixed impedance element and the impedance, Zsensor, form a voltage divider network such that changes in impedance, Zsensor, results in changes in voltage on Vout. The impedance block, Zsensor, shown in FIG. 3A is representative of two electrodes and the material residing between the electrodes. The impedance block, Zsensor, can also be represented by the equivalent circuit shown in FIG. 3B, where Rm is the resistance of the material between the electrodes and Cm is the capacitance of the material between the electrodes. The sensor is further described in U.S. patent application Ser. No. 08/766,864 filed on Dec. 13, 1996, which is incorporated herein.

As described above, wet end BW measurements can be obtained with one or more $UW^3$ sensors. Moreover, when more than one is employed, preferably the sensors are configured in an array of sensor cells. However, in some cases when an array does not physically fit in a location in the sheetmaking machine, a single sensor cell may be employed.

The sensor is sensitive to three physical properties of the material being detected: the conductivity or resistance, the dielectric constant, and the proximity of the material to the sensor. Depending on the material, one or more of these properties will dominate. The material capacitance depends on the geometry of the electrodes, the dielectric constant of the material, and its proximity to the sensor. For a pure dielectric material, the resistance of the material is infinite (i.e. $Rm=\infty$) between the electrodes and the sensor measures the dielectric constant of the material. In the case of highly conductive material, the resistance of the material is much less than the capacitive impedance (i.e. $Rm \ll Z_{cm}$), and the sensor measures the conductivity of the material.

To implement the sensor, a signal Vin is coupled to the voltage divider network shown in FIG. 3A and changes in the variable impedance block (Zsensor) is measured on Vout. In this configuration the sensor impedance, Zsensor, is: Zsensor=Zfixed*Vout/(Vin−Vout) (Eq. 1). The changes in impedance of Zsensor relates physical characteristics of the material such as material weight, temperature, and chemical composition. It should be noted that optimal sensor sensitivity is obtained when Zsensor is approximately the same as or in the range of Zfixed.

Cell Array

Figure 1B:
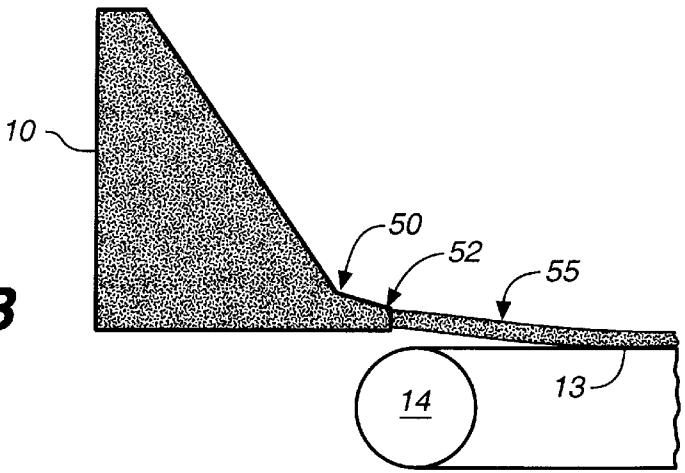
FIG. 1B shows the relationship of the slices in the headbox and the wire.
Figure 4:
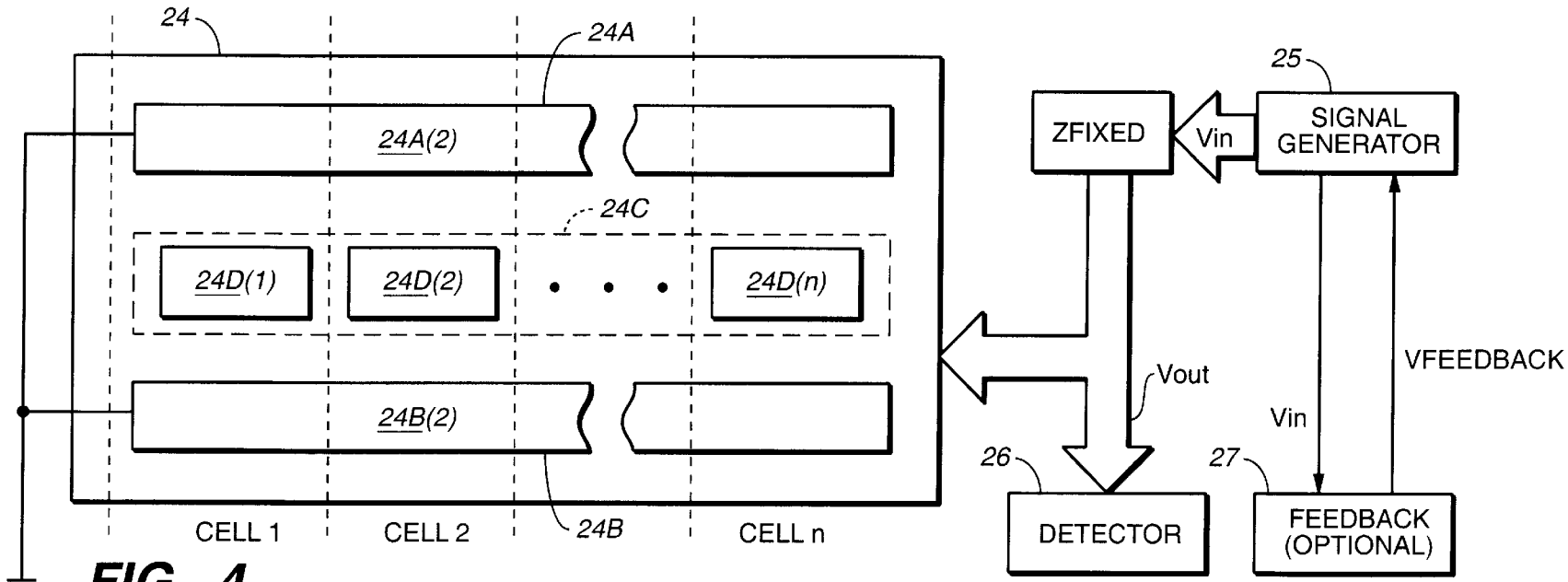
FIG. 4 shows a block diagram of a measurement apparatus including a sensor array in accordance with the present invention.

FIG. 4 illustrates a block diagram of one implementation of the sensor apparatus including cell array 24, signal generator 25, detector 26, and optional feedback circuit 27. Cell array 24 includes two elongated grounded electrodes 24A and 24B and center electrode 24C spaced apart and centered between electrodes 24A and 24B and made up of sub-electrodes 24D(1)–24D(n). A cell within array 24 is defined as including one of sub-electrodes 24D situated between a portion of each of the grounded electrodes 24A and 24B. For example, cell 2 includes sub-electrode 24D(2) and grounded electrode portions 24A(2) and 24B(2). For use in the system as shown in FIGS. 1 and 2, cell array 24 resides beneath and in contact with supporting web 12 and can be positioned either parallel to the machine direction (MD) or to the cross-direction (CD) depending on the type of information that is desired. In order to use the sensor apparatus to determine the weight of fiber in a wetstock mixture by measuring its conductivity, the wetstock must be in a state such that all or most of the water is held by the fiber. In this state, the water weight of the wetstock relates directly to the fiber weight and the conductivity of the water weight can be measured and used to determine the weight of the fiber in the wetstock.

Each cell is independently coupled to an input voltage (Vin) from signal generator 25 through an impedance element Zfixed and each provides an output voltage to voltage detector 26 on bus Vout. Signal generator 25 provides Vin. In one embodiment Vin is an analog waveform signal, however other signal types may be used such as a DC signal. In the embodiment in which signal generator 25 provides a waveform signal it may be implemented in a variety of ways and typically includes a crystal oscillator for generating a sine wave signal and a phase lock loop for signal stability. One advantage to using an AC signal as opposed to a DC signal is that it may be AC coupled to eliminate DC off-set.

Detector 26 includes circuitry for detecting variations in voltage from each of the sub-electrodes 24D and any conversion circuitry for converting the voltage variations into useful information relating to the physical characteristics of the aqueous mixture. Optional feedback circuit 27 includes a reference cell also having three electrodes similarly configured as a single cell within the sensor array. The reference cell functions to respond to unwanted physical characteristic changes in the aqueous mixture other than the physical characteristic of the aqueous mixture that is desired to be measured by the array. For instance, if the sensor is detecting voltage changes due to changes in water weight, the reference cell is configured so that it measures a constant water weight. Consequently, any voltage/conductivity changes exhibited by the reference cell are due to aqueous mixture physical characteristics other than weight changes (such as temperature and chemical composition). The feedback circuit uses the voltage changes generated by the reference cell to generate a feedback signal (Vfeedback) to compensate and adjust Vin for these unwanted aqueous mixture property changes (to be described in further detail below). The non-weight related aqueous mixture conductivity information provided by the reference cell may also provide useful data in the sheetmaking process.

Individual cells within sensor 24 can be readily employed in the system of FIGS. 1 and 2 so that each of the individual cells (1 to n) corresponds to each of the individual $UW^3$ sensors in the machine or cross direction. The length of each sub-electrode (24D (n)) determines the resolution of each cell. Typically, its length ranges from 1 in. to 6 in.

The sensor cells are positioned underneath the web, preferably upstream of the dry line, which on a fourdrinier, typically is a visible line of demarcation corresponding to the point where a glossy layer of water is no longer present on the top of the stock.

A method of constructing the array is to use a hydrofoil or foil from a hydrofoil assembly as a support for the components of the array. In a preferred embodiment, the grounded electrodes and center electrodes each has a surface that is flushed with the surface of the foil.

Figure 5A:
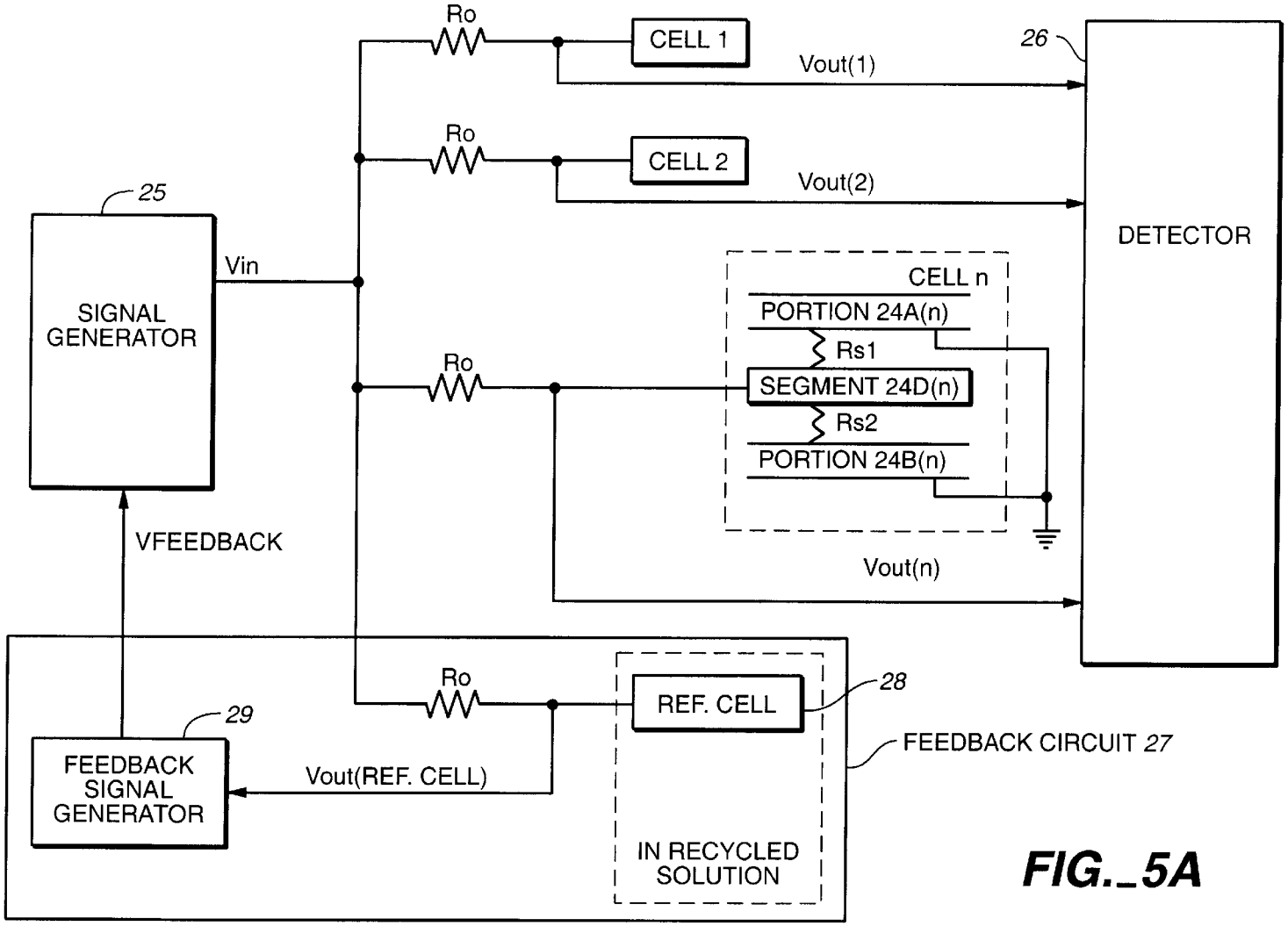
FIG. 5A shows an electrical representation of the block diagram shown in FIG. 4.
Figure 5B:
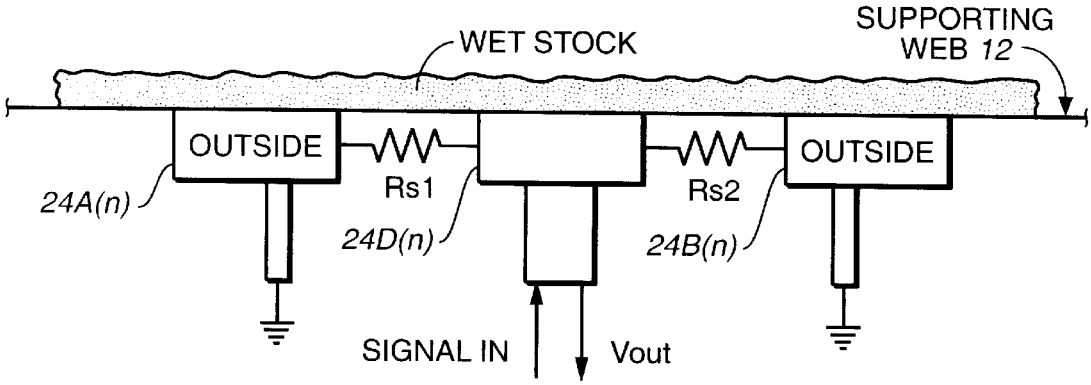
FIG. 5B shows a single sensor cell residing beneath a sheetmaking machine supporting web in accordance with the measurement apparatus of the present invention.

FIG. 5A shows an electrical representation of sensor cell array 24 (including cells 1–n) and the manner in which it functions to sense changes in conductivity of an aqueous mixture (i.e., wetstock). As shown, each cell is coupled to Vin from signal generator 25 through an impedance element which, in this embodiment, is resistive element Ro. Referring to cell n, resistor Ro is coupled to the center sub-electrode 24D(n). The outside electrode portions 24A(n) and 24B(n) are both coupled to ground. Also shown in FIG. 5A are resistors Rs1 and Rs2 which represent the conductance of the aqueous mixture between each of the outside electrodes and the center electrode. The outside electrodes are designed to be essentially equidistant from the center electrode and consequently the conductance between each and the center electrode is essentially equal (Rs1=Rs2=Rs). As a result, Rs1 and Rs2 form a parallel resistive branch having an effective conductance of half of Rs (i.e. Rs/2). It can also be seen that resistors Ro, Rs1, and Rs2 form a voltage divider network between Vin and ground. FIG. 5B also shows the cross-section of one implementation of a cell electrode configuration with respect to a sheetmaking machine in which electrodes 24A(n), 24B(n), and 24D(n) reside directly under the web 12 immersed within the aqueous mixture.

The sensor apparatus is based on the concept that the resistance Rs of the aqueous mixture and the weight/amount of an aqueous mixture are inversely proportional. Consequently, as the weight increases/decreases, Rs decreases/increases. Changes in Rs cause corresponding fluctuations in the voltage Vout as dictated by the voltage divider network including Ro, Rs1, and Rs2.

The voltage Vout from each cell is coupled to detector 26. Hence, variations in voltage directly proportional to variations in resistivity of the aqueous mixture are detected by detector 26 thereby providing information relating to the weight and amount of aqueous mixture in the general proximity above each cell. Detector 26 may include means for amplifying the output signals from each cell and in the case of an analog signal will include a means for rectifying the signal to convert the analog signal into a DC signal. In one implementation well adapted for electrically noisy environments, the rectifier is a switched rectifier including a phase lock-loop controlled by Vin. As a result, the rectifier rejects any signal components other than those having the same frequency as the input signal and thus provides an extremely well filtered DC signal. Detector 26 also typically includes other circuitry for converting the output signals from the cell into information representing particular characteristics of the aqueous mixture such as weight.

FIG. 5A also shows feedback circuit 27 including reference cell 28 and feedback signal generator 29. The concept of the feedback circuit 27 is to isolate a reference cell such that it is affected by aqueous mixture physical characteristic changes other than the physical characteristic that is desired to be sensed by the system. For instance, if water weight is desired to be sensed then the water weight is kept constant so that any voltage changes generated by the reference cell are due to physical characteristics other than water weight changes. In one embodiment, reference cell 28 is immersed in an aqueous mixture of recycled water which has the same chemical and temperature characteristics of the water in which cell array 24 is immersed in. Hence, any chemical or temperature changes affecting conductivity experienced by array 24 is also sensed by reference cell 28. Furthermore, reference cell 28 is configured such that the weight of the water is held constant. As a result voltage changes Vout(ref. cell) generated by the reference cell 28 are due to changes in the conductivity of the aqueous mixture, not the weight. Feedback signal generator 29 convert the undesirable voltage changes produced from the reference cell into a feedback signal that either increases or decreases Vin and thereby cancels out the affect of erroneous voltage changes on the sensing system. For instance, if the conductivity of the aqueous mixture in the array increases due to a temperature increase, then Vout(ref. cell) will decrease causing a corresponding increase in the feedback signal. Increasing Vfeedback increases Vin which, in turn, compensates for the initial increase in conductivity of the aqueous mixture due to the temperature change. As a result, Vout from the cells only change when the weight of the aqueous mixture changes.

Figure 6A:
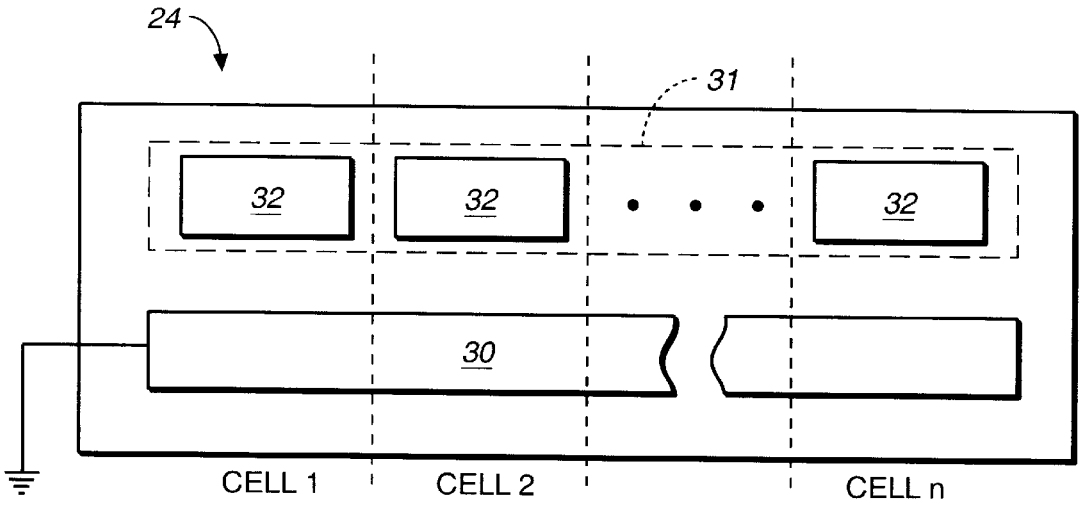
FIGS. 6A and 6B show a second embodiment of a sensor array and an equivalent electrical representation.
Figure 6B:
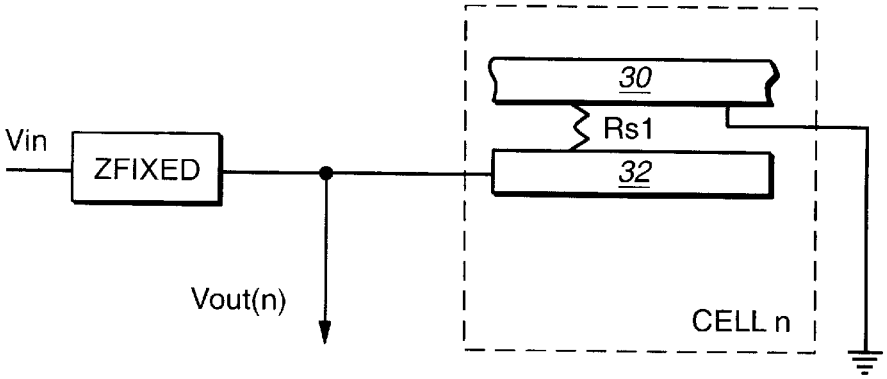

One reason for configuring the cell array as shown in FIG. 5A, with the center electrode placed between two grounded electrodes, is to electrically isolate the center electrode and to prevent any outside interaction between the center electrode and other elements within the system. However, it should also be understood that the cell array can be configured with only two electrodes. FIG. 6A shows a second embodiment of the cell array for use in the sensor. In this embodiment, the sensor includes a first grounded elongated electrode 30 and a second partitioned electrode 31 including sub-electrodes 32. A single well is defined as including one of the sub-electrodes 32 and the portion of the grounded electrode 30 which is adjacent to the corresponding sub-electrode. FIG. 6A shows cells 1–n each including a sub-electrode 32 and an adjacent portion of electrode 30. FIG. 6B shows a single cell n, wherein the sub-electrode 32 is coupled to Vin from the signal generator 25 through a fixed impedance element Zfixed and an output signal Vout is detected from the sub-electrode 32. It should be apparent that the voltage detected from each cell is now dependent on the voltage divider network, the variable impedance provided from each cell and the fixed impedance element coupled to each sub-electrode 32. Hence, changes in conductance of each cell is now dependent on changes in conductance of Rs1. The remainder of the sensor functions in the same manner as with the embodiment shown in FIG. 6A. Specifically, the signal generator provides a signal to each cell and feedback circuit 27 compensates Vin for variations in conductance that are not due to the characteristic being measured.

Figure 7A:
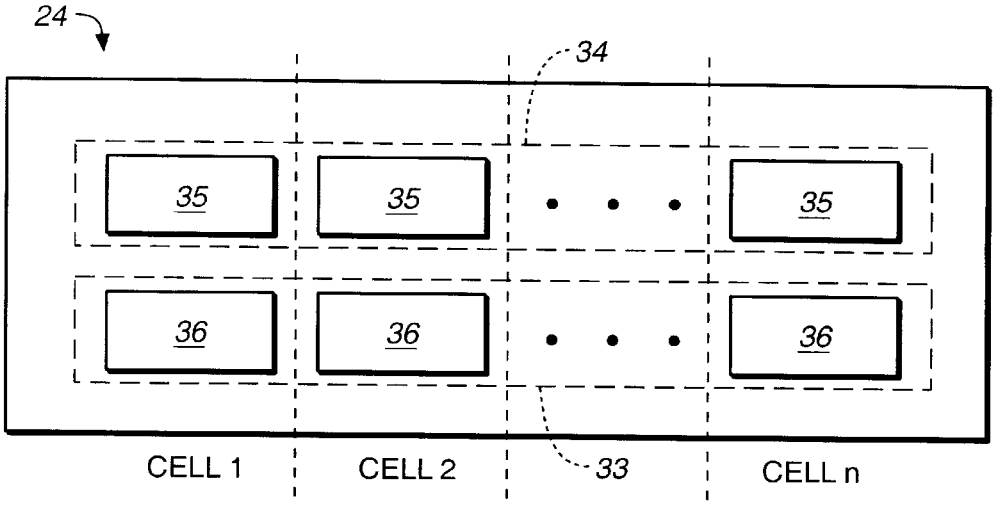
FIGS. 7A and 7B show a third embodiment of a sensor array and an equivalent electrical representation.
Figure 7B:
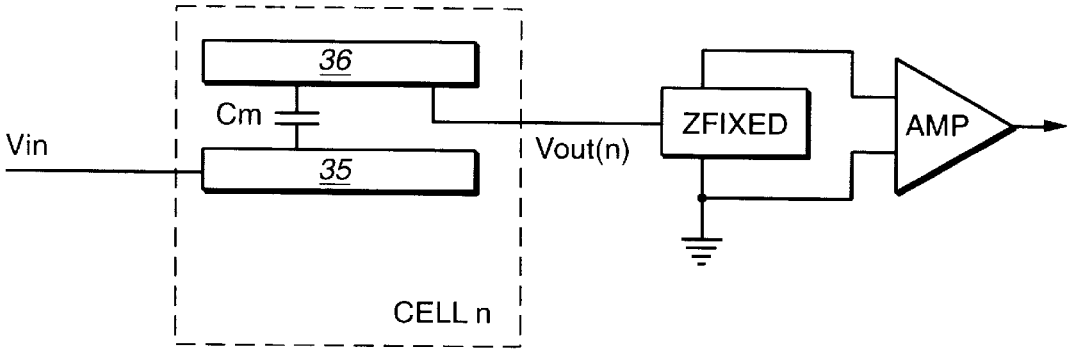

In still another embodiment of the cell array shown in FIGS. 7A and 7B, the cell array includes first and second elongated spaced apart partitioned electrodes 33 and 34, each including first and second sets of sub-electrodes 36 and 35, (respectively). A single cell (FIG. 7B) includes pairs of adjacent sub-electrodes 35 and 36, wherein sub-electrode 35 in a given cell is independently coupled to the signal generator and sub-electrode 36 in the given cell provides Vout to a high impedance detector amplifier which provides Zfixed. This embodiment is useful when the material residing between the electrodes functions as a dielectric making the sensor impedance high. Changes in voltage Vout is then dependent on the dielectric constant of the material. This embodiment is conducive to being implemented at the dry end of a sheetmaking machine (and particularly beneath and in contact with the dry sheet since dry paper has high resistance and its dielectric properties are easier to measure.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of controlling the formation of a sheet of wet stock comprising fibers wherein the wet stock is formed on a water permeable wire moving at a wire speed of a de-watering machine that has a headbox having at least one slice, wherein each slice has an aperture through which wet stock is introduced onto the wire at a stock jet speed, said method comprising the steps of:

a) placing at least two water weight sensors underneath and adjacent to the wire and which are positioned at different locations in the direction of movement of the wire and upstream from a dry line which develops during operation of the machine;

b) operating the machine and measuring the water weights of the sheet of wet stock with the water weight sensors;

c) generating signals that are indicative of the water weight measurements and developing a water weight profile based on the signals; and d) adjusting at least one of said stock jet speed or wire speed so that the water weight profile match a preselected water weight profile by measuring the stock jet speed and the wire speed ratio and maintaining this ratio between about 0.95 to 1.05 provided that the ratio is not maintained at exactly 1.

2. The method of claim 1 wherein the headbox has actuators that control the discharge of wet stock through a plurality of slices and step d) comprises controlling the discharge of wet stock through the slices.

3. The method of claim 1 wherein the headbox comprises a chamber containing wet stock that is maintained at a pressure level, and step d) comprises adjusting the pressure within the chamber.

4. The method of claim 1 wherein each of said sensors includes a first electrode and a second electrode which is spaced-apart and adjacent to said first electrode, said wet stock being between and in close proximity to said first and said second electrodes, said sensor is coupled in series with an impedance element between an input signal and a reference potential; and wherein fluctuations in at least one of said properties of said wet stock causes changes in voltage measured across said sensor.

5. The method of claim 4 wherein said first electrode is coupled to said input signal and said second electrode is coupled to said impedance element.

6. The method of claim 5 wherein said second electrode comprises a set of electrically isolated sub-electrodes and said impedance element comprises a plurality of resistive elements, wherein said first electrode is coupled to said input signal and each of said set of sub-electrodes is coupled to one of said plurality of resistive elements.

7. The method of claim 4 further comprising means for providing a feedback signal to adjust said input signal such that said fluctuations in at least one of said properties are due to fluctuations in a single physical characteristic of said wet stock.

8. The method of claim 7 wherein said physical properties include dielectric constant, conductivity, and proximity of said portion of said wet stock to said sensor and said single physical characteristic of said wet stock comprises one of weight, chemical composition, and temperature.

9. The method of claim 4 wherein said impedance element is one of an inductive element and capacitive element each having an associated impedance and said input signal has an associated frequency and wherein said associated impedance of said one of said inductive and capacitive element may be set to a particular magnitude by adjusting said associated frequency to a given magnitude.

10. The method of claim 9 wherein said sensor has an associated impedance and said associated frequency is adjusted such that said sensor impedance and said impedance of said one of said capacitive element and said inductive element are approximately equal.

11. The method of claim 4 wherein said first electrode is coupled to said impedance element and said second electrode is coupled to said reference potential.

12. The method of claim 11 wherein said impedance element comprises a plurality of resistive elements and said first electrode comprises a plurality of electrically isolated sub-electrodes which are each coupled to one of said plurality of resistive elements.

13. The method of claims 11 further including a third electrode coupled to said reference potential, said first electrode being spaced-apart and residing between said second and said third electrodes, wherein another portion of said sheet of material is between and in close proximity to said first and said third electrodes.

14. The method of claim 1 wherein the at least two water weight sensors are positioned substantially in tandem.

15. The method of claim 14 wherein step a) comprises placing at least three sensors underneath and adjacent to the wire.

16. The method of claim 1 wherein the wet stock is paper stock.

17. A system of controlling that formation of wet stock which comprises fibers on a moving water permeable wire of a de-watering machine that comprises a headbox having at least one slice, wherein each slice has an aperture through which wet stock is discharged at a certain stock jet speed onto the wire that is moving at a certain wire speed, which system comprises:

a) at least two water weight sensors that are positioned adjacent to the wire wherein the at least two sensors are positioned at different locations in the direction of movement of the wire and downstream from a dry line which develops during operation of the machine and the sensors generate signals indicative of a water weight profile made up of a multiplicity of water weight measurements;

b) means for adjusting at least one of the stock jet speed or wire speed to cause the water weight profile to match a preselected water weight profile; and c) means for measuring the stock jet speed and the wire speed ratio and maintaining this ratio between about 0.95 to 1.05 provided that the ratio is not maintained at exactly 1.

18. The system of claim 17 wherein said means for adjusting at least one of the stock jet speed or the wire speed regulates the stock jet speed.

19. The system of claim 18 wherein the headbox comprises a chamber containing wet stock that is maintained at a pressure level and the means for regulating the jet speed regulates said pressure.

20. The system of claim 17 wherein the headbox has actuators that control the discharge of wet stock through a plurality of slices and wherein the means for regulating jet speed regulates the discharge of wet stock through the slices.

21. The system of claim 20 wherein the water weight sensors are positioned substantially in tandem.

22. The system of claim 21 wherein the system comprises at least three sensors that are underneath and adjacent to the wire.

23. The system of claim 20 wherein the wet stock is paper stock.

24. The system of claim 17 wherein each of said sensors includes a first electrode and a second electrode which is spaced-apart and adjacent to said first electrode, said wet stock being between and in close proximity to said first and said second electrodes, said sensor is coupled in series with said impedance element between an input signal and a reference potential; and wherein fluctuations in at least one of said properties of said wet stock causes changes in voltage measured across said sensor.

25. The system of claim 24 wherein said first electrode is coupled to said impedance element and said second electrode is coupled to said reference potential.

26. The system of claim 25 wherein said impedance element comprises a plurality of resistive elements and said first electrode comprises a plurality of electrically isolated sub-electrodes which are each coupled to one of said plurality of resistive elements.

27. The system of claim 26 wherein said second electrode comprises a set of electrically isolated sub-electrodes and said impedance element comprises a plurality of resistive elements, wherein said first electrode is coupled to said input signal and each of said set of sub-electrodes is coupled to one of said plurality of resistive elements.

28. The system of claims 25 further including a third electrode coupled to said reference potential, said first electrode being spaced-apart and residing between said second and said third electrodes, wherein another portion of said sheet of material is between and in close proximity to said first and said third electrodes.

29. The system of claim 24 wherein said first electrode is coupled to said input signal and said second electrode is coupled to said impedance element.

30. The system of claim 24 further comprising means for providing a feedback signal to adjust said input signal such that said fluctuations in at least one of said properties are due to fluctuations in a single physical characteristic of said wet stock.

31. The system of claim 30 wherein said physical properties include dielectric constant, conductivity, and proximity of said portion of said wet stock to said sensor and said single physical characteristic of said wet stock comprises one of weight, chemical composition, and temperature.

32. The system of claim 24 wherein said impedance element is one of an inductive element and capacitive element each having an associated impedance and said input signal has an associated frequency and wherein said associated impedance of said one of said inductive and capacitive element may be set to a particular magnitude by adjusting said associated frequency to a given magnitude.

33. The system of claim 32 wherein said sensor has an associated impedance and said associated frequency is adjusted such that said sensor impedance and said impedance of said one of said capacitive element and said inductive element are approximately equal.

34. A method of controlling the formation of a sheet of wet stock comprising fibers wherein the wet stock is formed on a water permeable wire of a de-watering machine that has a refiner that subjects the fibers to mechanical action, said refiner being subject to a variable load, and a headbox having at least one slice, wherein each slice has an aperture through which wet stock is introduced at a stock jet speed onto the wire that moves at a wire speed, said method comprising the steps of:

a) placing at least two water weight sensors underneath and adjacent to the wire and which are positioned at different locations in the direction of movement of the wire and upstream from a dry line which develops during operation of the machine;

b) operating the machine and measuring the water weights of the sheet of wet stock with the water weight sensors;

c) generating signals that are indicative of the water weight measurements and developing a water weight profile based on the signals; and d) adjusting the variable load of the refiner so that the water weight profile match a preselected water weight profile, whereby the preselected water weight profile is created by a process that comprises the steps of:

(i) operating the machine and measuring the water weights of the sheet of the wet stock with the water weight sensors with the proviso that the machine operates at a stock jet speed to wire speed ratio between about 0.95 to 1.05 provided that the ratio is not maintained at exactly 1;

(ii) drying the sheet of wet stock to form a sheet of fibrous material;

(iii) measuring a physical property of the sheet of fibrous material;

(iv) generating signals that are indicative of the water weight measurements and developing a water weight profile based on the signals; and (v) recording the water weight profile as the preselected water weight profile when the measured physical property of the material, as determined by the measurement of step (iii) reaches a desired level.

35. A system of controlling the formation of a sheet of fibrous material from wet stock which comprises fibers on a moving water permeable wire of de-watering machine that comprises a refiner that subjects the fibers to mechanical action, said refiner having a motor load controller, and a headbox having at least one slice, wherein each slice has an aperture through which wet stock is discharged at a stock jet speed onto the wire that moves at a wire speed, which system comprises:

a) at least two water weight sensors that are positioned adjacent to the wire wherein the at least two sensors are positioned at different locations in the direction of movement of the wire and downstream from a dry line which develops during operation of the machine and the sensors generate signals indicative of a water weight profile made up of a multiplicity of water weight measurements;

b) means for developing a base water weight profile that is generated in the formation of a sheet of fibrous material having a desired measured physical property; and c) means for adjusting the motor load controller to cause the water weight profile to match the base water weight profile, with the proviso that the machine operates at a stock jet speed to wire speed ratio between about 0.95 to 1.05 provided that the ratio is not maintained at exactly 1.

* * * * *